US008210278B2

(12) United States Patent
Eilo et al.

(10) Patent No.: US 8,210,278 B2
(45) Date of Patent: Jul. 3, 2012

(54) METHOD FOR DRILLING ROCK

(75) Inventors: Erkki Eilo, Tampere (FI); Jouko Muona, Siuro (FI); Timo Kemppainen, Tampere (FI); Jouni Koivisto, Hattula (FI)

(73) Assignee: Sandvik Mining and Construction Oy, Tampere (FI)

( * ) Notice: Subject to any disclaimer, the term of this patent is extended or adjusted under 35 U.S.C. 154(b) by 252 days.

(21) Appl. No.: 12/440,093

(22) PCT Filed: Sep. 4, 2007

(86) PCT No.: PCT/FI2007/050471

§ 371 (c)(1), (2), (4) Date: Mar. 5, 2009

(87) PCT Pub. No.: WO2008/029000

PCT Pub. Date: Mar. 13, 2008

(65) Prior Publication Data

US 2010/0025108 A1 Feb. 4, 2010

(30) Foreign Application Priority Data

Sep. 6, 2006 (FI) ..... 20065553

(51) Int. Cl.

| | |
|---|---|
| ***E21B 44/00*** | (2006.01) |
| ***E21B 44/04*** | (2006.01) |
| ***E21B 44/06*** | (2006.01) |

(52) U.S. Cl. ..... 175/24; 175/27; 175/108

(58) Field of Classification Search ..... 175/24, 175/27, 108; 173/4, 11

See application file for complete search history.

(56) References Cited

U.S. PATENT DOCUMENTS

| | | | | |
|---|---|---|---|---|
| 4,267,892 | A | 5/1981 | Mayer | |
| 5,844,133 | A | 12/1998 | Goto et al. | |
| 6,957,707 | B2 | 10/2005 | Koivunen et al. | |
| 2004/0140112 | A1 * | 7/2004 | Salminen et al. | 173/1 |
| 2004/0216922 | A1 * | 11/2004 | Koivunen et al. | 175/24 |
| 2005/0010385 | A1 * | 1/2005 | Heck | 703/10 |

FOREIGN PATENT DOCUMENTS

| | | |
|---|---|---|
| DE | 1 608 374 | 1/1971 |
| DE | 3 902 127 | 7/1990 |
| FI | 115481 | 5/2005 |

* cited by examiner

*Primary Examiner* — Cathleen Hutchins

(74) *Attorney, Agent, or Firm* — Morgan, Lewis & Bockius LLP

(57) ABSTRACT

The invention relates to a method for drilling rock, wherein holes to be drilled are determined prior to drilling as a drilling pattern wherein for each hole, a starting place, direction and hole depth for drilling are determined with respect to the rock to be drilled. In the invention, hole-type-specific drilling parameters are determined for the holes to be drilled, and during a drilling phase a drill rig automatically selects drilling parameters for each hole to be drilled on the basis of the hole type of the particular hole.

15 Claims, 5 Drawing Sheets

METHOD FOR DRILLING ROCK

CROSS REFERENCE TO RELATED APPLICATIONS

This application is the National Stage of International Application No. PCT/FI2007/050471, filed Sep. 4, 2007, and claims benefit of Finnish Application No. FI 20065553, filed Sep. 6, 2006.

BACKGROUND OF THE INVENTION

The invention relates to a method for drilling rock, in which method holes to be drilled are determined prior to drilling as a drilling pattern wherein for each hole, a starting place, direction and hole depth for drilling are determined with respect to the rock to be drilled.

On one hand, present-day rock drilling employs completely hydraulically controlled drill rigs and, on the other hand, electro-hydraulically controlled rock drills. In different drilling situations and when drilling different holes, in connection with hydraulic drill rigs a driller has to set different settings and adjustable drilling parameters on the basis of experience. Consequently, the final result heavily depends on the driller's skills, and still there is no way to monitor it particularly clearly. In connection with an electro-hydraulic drill rig, in turn, two drilling modes, i.e. normal drilling and reaming drilling, are typically used between which the driller may choose during drilling. In these, respectively, an already selected drilling parameter set is provided, i.e. certain values have been in advance selected for the selectable and adjustable drilling parameters which cannot be changed by the driller or which are laborious and time-consuming to change. This, in turn, means that drilling efficiency and drilling speed are lower than what could actually be achieved by the drill rig, and thus the efficiency is poorer than the actual possible efficiency. Such hole drilling is performed in connection with both tunnel boring and surface excavation. In tunnel drilling and in surface drilling, different holes have different requirements, and the driller's skills play a crucial role as far as the final result is concerned.

BRIEF DESCRIPTION OF THE INVENTION

An object of this invention is to provide a method which enables the drilling efficiency to be enhanced without losing the accuracy required by drilling and holes of sufficient quality as far as other operation is concerned to be achieved.

The method according to the invention is characterized in that the holes provided in the drilling pattern are grouped into hole types according to the purpose of a hole, that hole-type-specific drilling parameters are determined for holes of each hole type, and that during a drilling phase a drill rig automatically selects drilling parameters for each hole to be drilled on the basis of the hole type of the particular hole.

The idea underlying the invention is that drilling parameters are determined according to hole type such that holes to be drilled for different purposes are provided with suitable drilling parameters which have been selected according to the purpose of the hole and which enable the accuracy and other properties of the hole to be made as appropriate as possible.

An advantage of the invention is that drilling is provided with a wider range of adjustment possibilities so that it is possible to provide drilling parameters separately also for more exceptional and less common drilling situations. A further advantage of the invention is that in this way, the speed of control of booms of a drill rig can be enhanced during drilling since with respect to certain hole types when the accuracy requirement is smaller, the boom can also be moved to a starting place with a sufficient accuracy more quickly. A still further advantage is that depending on the requirement set by a hole, a sufficient amount of time may be spent for collaring and drilling the actual hole, which also facilitates and speeds up the drilling and, respectively, collaring of less demanding holes may be carried out faster and the process may move on to the actual drilling more quickly by using high drilling powers.

BRIEF DESCRIPTION OF THE DRAWINGS

The invention will be described by way of example in the accompanying drawings, in which FIGS. 1 to 6 schematically show different holes for tunnel boring.

DETAILED DESCRIPTION OF SOME EMBODIMENTS OF THE INVENTION

FIGS. 1 to 6 schematically show by way of example a cross section 1 of a tunnel and drill holes used in the drilling thereof, typically all being shown as a single drilling pattern comprising different holes which are necessary for different purposes and which differ in necessary properties.

Figure 1:
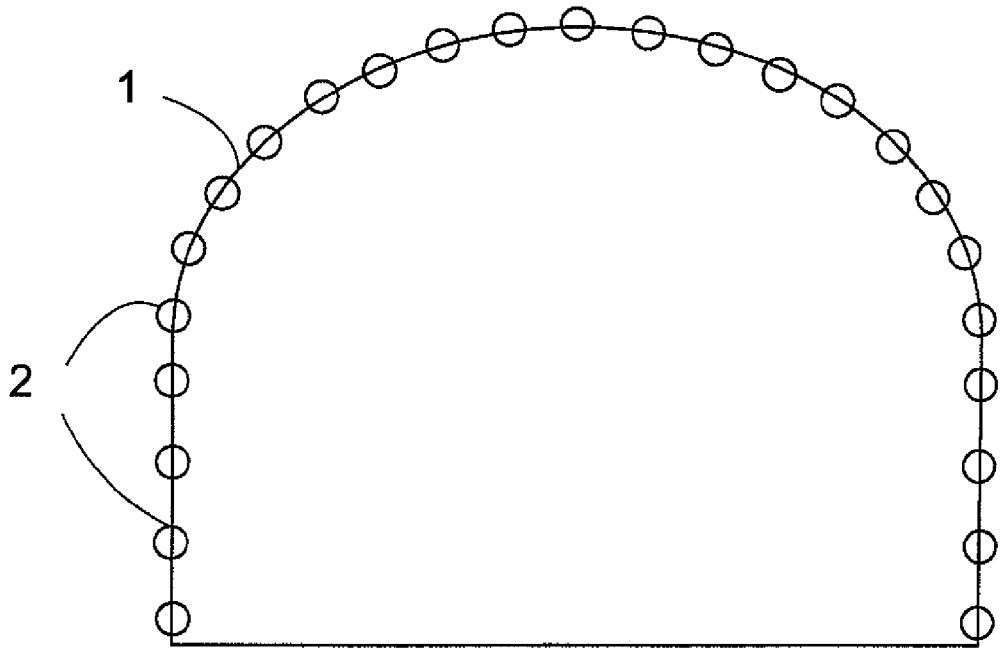

FIG. 1 shows contour holes designated by reference numeral 2. Such contour holes are holes to be drilled into a tunnel's wall and ceiling to determine the contour of the tunnel. These holes are extremely important since they determine the shape and size of the tunnel. At the same time, it is the accuracy of these holes that determines how accurately excavation may be carried out without excavating excessive rock unnecessarily.

Figure 2:
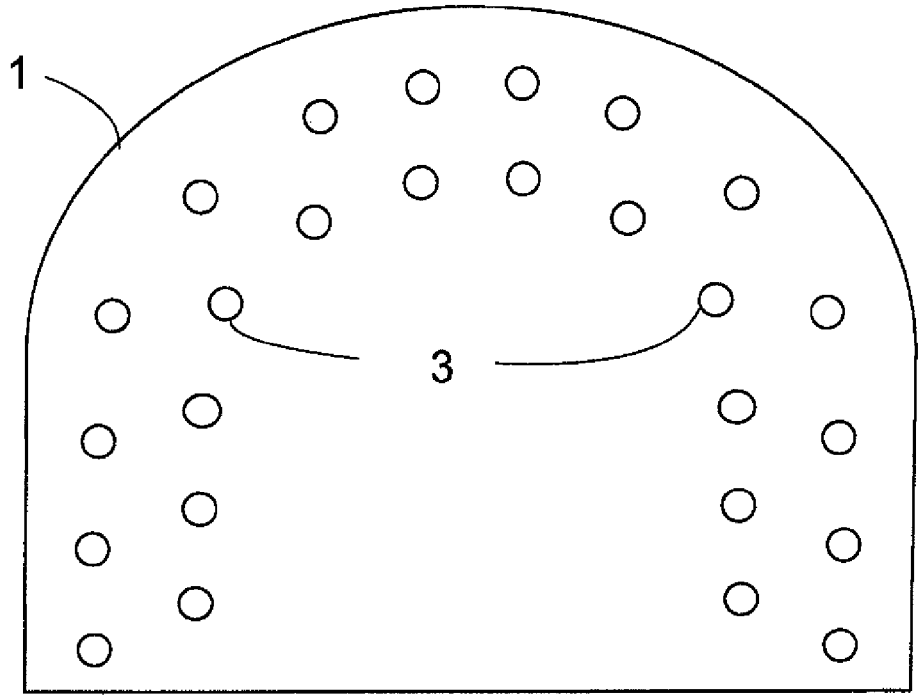

Designated by reference numeral 3, FIG. 2 shows field holes or auxiliary holes. With these holes, a correct depth is essential. The accuracy requirement for correct depth depends on the blasting technique used. The most important thing is the correct location of the final point of a hole; this allows the initial end of the hole to slightly deviate from a determined one.

Figure 3:
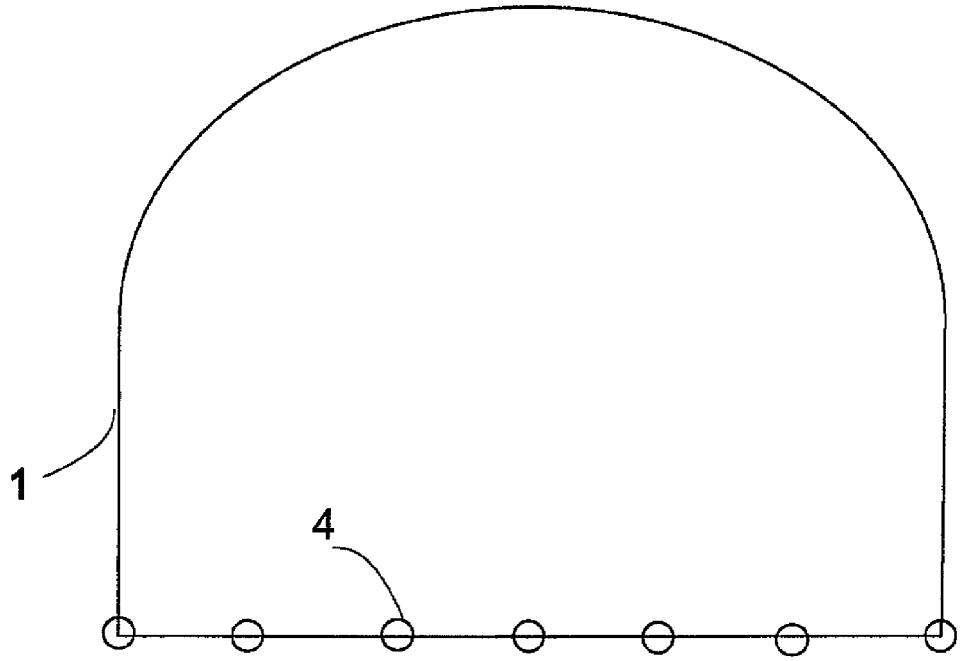

FIG. 3 shows lifter holes designated by reference numeral 4. These are similar to the contour holes since they are used for determining the level and shape of the tunnel's floor. These, too, have to be accurately and correctly provided in terms of location and direction as well as depth. An erroneous location or direction of these holes may also cause a lot of unnecessary excavation.

Figure 4:
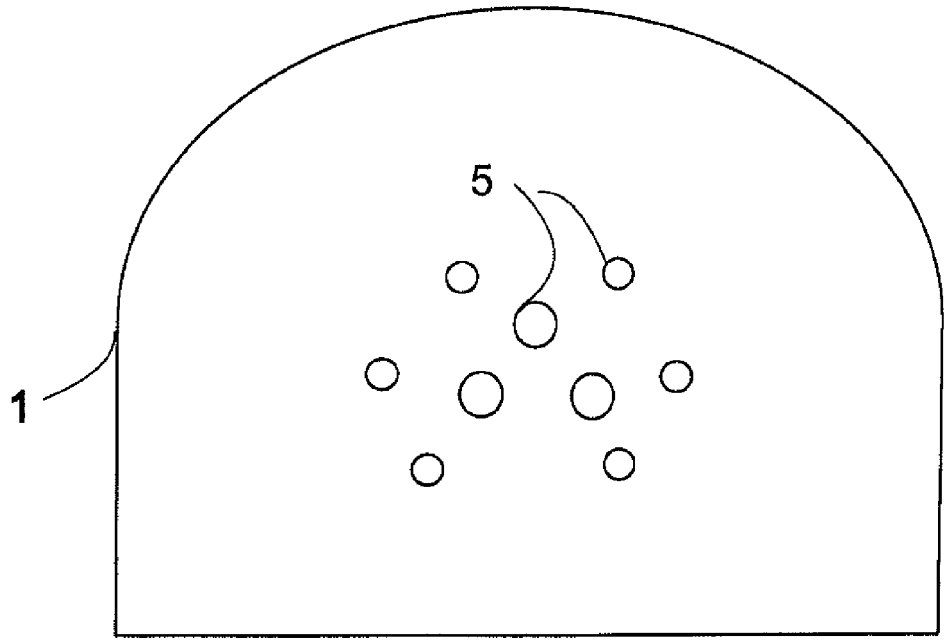

FIG. 4 shows cut holes designated by reference number 5. Such cut holes are first blasted to produce a sufficient space in the rock for rock material being removed and expanding in connection with the blasting of other holes. The accuracy requirement for such holes is extremely high and, irrespective of the starting conditions, the holes have to be drilled at exactly the desired place, so with these holes, the collaring phase, inter alia, has to be carried out very carefully and accurately.

Figure 5:
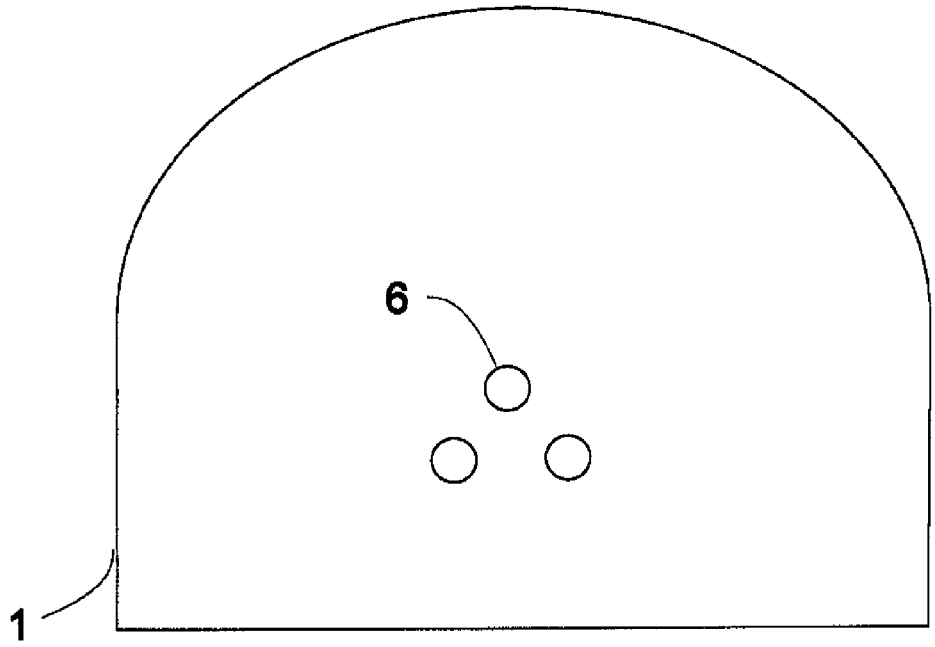

FIG. 5 shows ream holes designated by reference numeral 6. Such ream holes are used for reaming or enlarging so-called pilot holes of previously drilled starting holes to a size suitable for blasting. If desired, the ream holes may also be drilled with no pilot holes, in which case drilling has to be carried out with extreme accuracy, as in connection with the starting holes.

Figure 6:
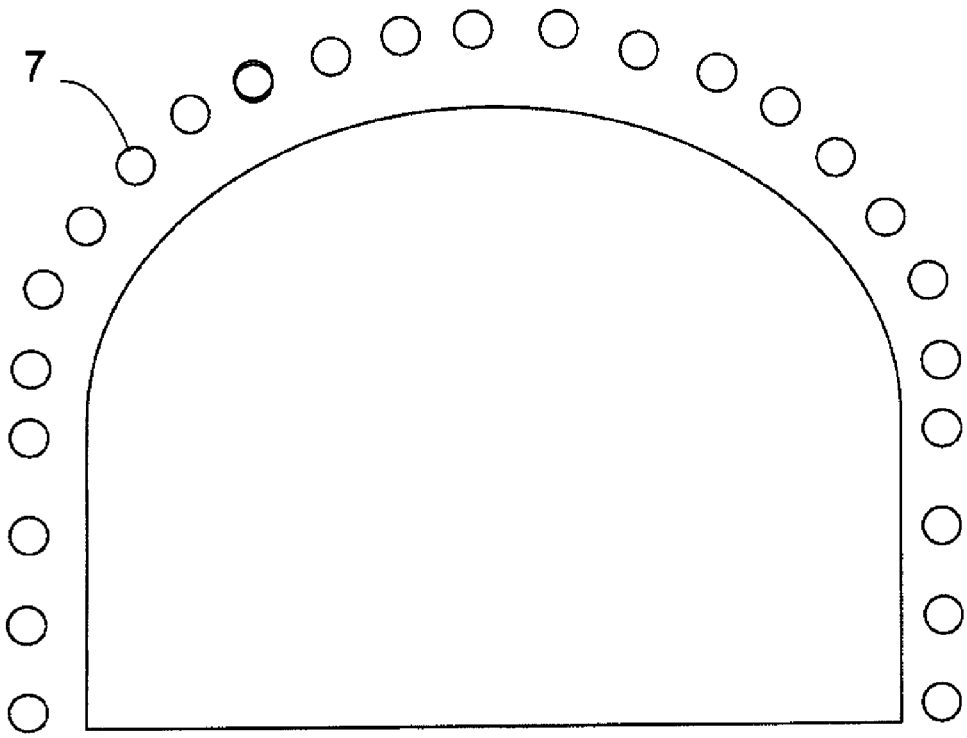

FIG. 6 shows so-called casing holes designated by reference numeral 7. These are used when the initial rock is extremely soft and there is reason to doubt its strength as such. In such a case, long holes are drilled around the contour of the tunnel, which are then injected with concrete or chemicals to form a protective and supportive structure around the tunnel to be.

Furthermore, various holes necessary for special purposes exist. These include research holes, injection holes and bolting holes.

The purpose of a research hole is to analyze rock properties in the direction of advance for the actual excavation and associated drilling.

Injection holes are typically 20 to 30 meter long holes that are used for strengthening the rock material. After drilling, the holes are filled up with injected concrete, which simultaneously fills cavities and cracks in the rock and prevents water from entering the tunnel.

Bolting holes are needed for strengthening a tunnel. Such holes are drilled into the surface of the tunnel substantially perpendicularly and after drilling a deformed steel bar or a wire rope is soldered thereto with concrete or resin. Various expanding anchor bolts also exist.

All these hole types have unique accuracy requirements, which affects the values of drilling parameters used in the drilling.

Figure 7:
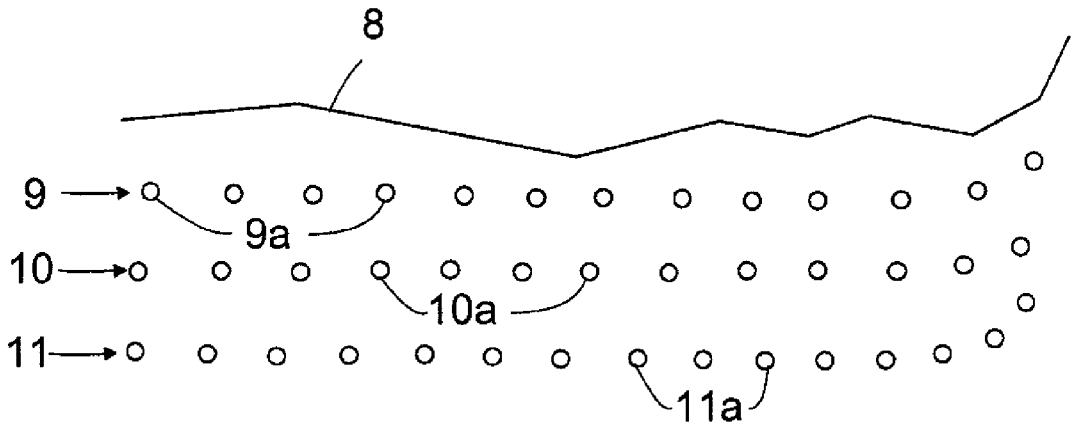
FIG. 7 shows an example of a drilling pattern used for surface drilling.
Figure 8:
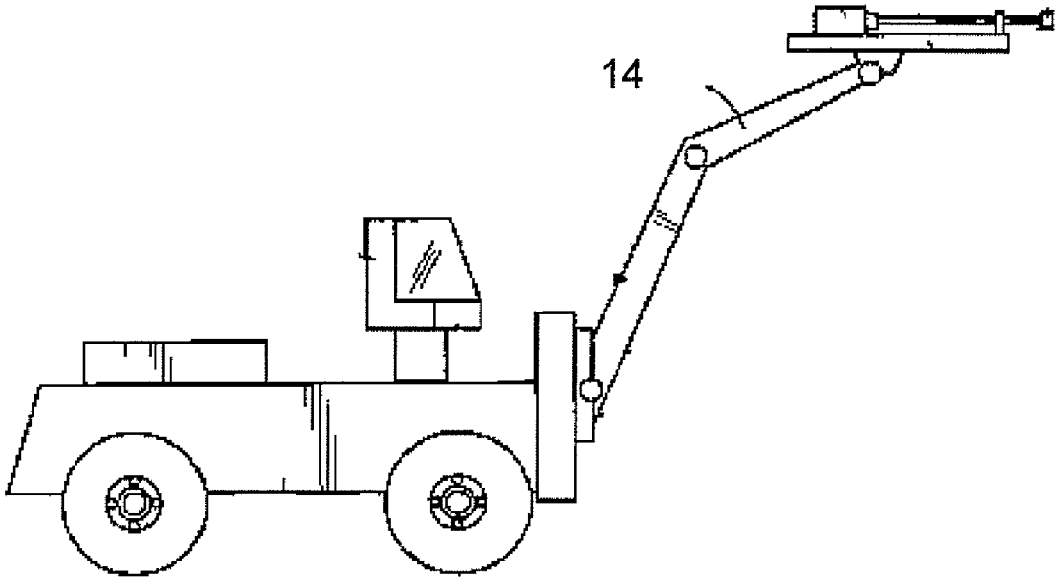
FIG. 8 shows an example of a drilling rig with a drilling boom 14.

FIG. 7 shows an example of a drilling pattern to be used in surface drilling. It shows by way of example an edge 8 of excavated rock, at which a previous excavation phase ends, for instance. Away from the edge 8, approximately in the direction of the edge 8, for example, hole rows 9 to 11 are planned to be drilled to further excavate the rock. Each hole row 9 to 11 or even each hole 9*a* to 11*a* may be provided with determined drilling parameters as necessary, taking into account e.g. the necessary excavation accuracy, starting of blasting different holes, etc. Particularly, if the last hole row is meant to follow the final rock surface remaining after excavation, the accuracy of its drilling parameters and hole locations has to be taken into account when setting the drilling parameters.

Drilling comprises various different parts and phases, for each of which different drilling parameters may be selected when necessary, even for each hole. Such parts or phases include positioning a drill boom, collaring, transition from collaring to actual drilling, actual drilling, feeding motion during drilling, flushing, return motion after drilling, etc.

With each hole, a drilling phase may start with positioning the drill boom when the drill rig is in a position which enables drilling which, depending on the location and hole type, may require e.g. careful control and even slow movement rate when moving the parts of the boom and a feed beam with respect to one another in order to achieve the desired accuracy. In drilling of other holes, in turn, when the accuracy requirement is substantially lower, high movement rates may be used.

In control of the different phases of drilling, it is possible to use various different drilling parameters, depending on the situation. In collaring, e.g. a starting time and/or length may be used as a drilling parameter. When moving on from collaring to the actual drilling, a so-called ramp, i.e. a stepped or stepless transition from collaring values to actual drilling values, may be used in such a transition phase. A ratio between striking power and feed pressure and/or speed, for instance, may then be used as a drilling parameter. Some most common drilling parameters used in the actual drilling are the striking power of an impact device as well as the feed pressure of pressure fluid of the impact device, feed force or feed motion rate. The pressure or flow rate of a flushing medium may also be used as a drilling parameter.

Various alternative drilling control methods may also be used as drilling parameters. Such control methods include moment adjustment based on rotating pressure which is kept constant, adjustment based on feed-impact pressure ratio, drilling taking place at a constant feed rate, etc., all known per se.

Different automatic monitoring modes are also provided for different drilling situations. These include so-called fissure automations, which operate when a drill bit tends to get stuck. In such a case, fissure automation slows down the feed and, when necessary, reverts it to a return motion. Also this may be used as a drilling parameter. Similarly, flushing medium flow monitoring may be used as a drilling parameter. All drilling parameters may be changed and, when necessary, selected even hole-specifically; thus, e.g. a ramp, i.e. a transition phase from collaring to actual drilling, may be different for each hole, if necessary.

When the drilling has come to an end, a drill rod has to be pulled out of the hole. Then, a pulling rate and a flushing medium flow rate may be drilling parameters, for instance.

The drilling parameters for drill holes may be determined in different ways. In an embodiment, the drilling parameters for holes are determined in advance according to hole type, and the drilling parameters of each hole type are stored in the memory of the drill rig. In such a case, the drilling pattern only needs to determine the hole type of each hole, and while a hole is being drilled, the drill rig drills the hole according to the hole type drilling parameters stored in its memory. In another embodiment, the drilling parameters of each hole type or hole are determined already in the drilling pattern, so that the drill rig drills the holes according to the hole-type-specific drilling parameters provided by the drilling pattern.

The drill holes and thus their drilling parameters may also be determined on other grounds, e.g. according to different circumstances. In such a case, drilling parameters may be determined for holes e.g. on the basis of a drilling site, drilling equipment, even a driller carrying out the drilling work, or the like. Furthermore, drilling parameters may be determined according to combinations of two or more aspects. The idea is that the drilling parameters for drilling a hole are selected according to drilling conditions both in tunnel boring and in surface drilling.

In addition to tunnel boring, the invention may be applied to surface drilling, where rock or other material is broke loose. Then, the requirements set for different holes and the necessary drilling parameters may differ from those used in tunnel boring. The important thing is, of course, that a hole to be drilled for a certain purpose is provided with drilling parameters determined for the particular hole according to the requirements set for the same, and by use of such parameters a result as appropriate as possible is achieved.

The drawings and the related description are only intended to illustrate the idea of the invention. In its details, the invention may vary within the scope of the claims.

The invention claimed is:

1. A method for drilling rock comprising:

prior to drilling, determining a drilling pattern of holes to be drilled, wherein the drilling pattern includes, for each hole, a starting place, direction and hole depth for drilling determined with respect to the rock to be drilled, the holes provided in the drilling pattern being grouped into at least two different hole types according to the purpose of a hole, and wherein each hole type includes more than one hole, determining an accuracy requirement for each hole type;

determining hole-type-specific drilling parameters based on the accuracy requirement for each hole type in the drilling pattern, determining, for each hole in the drilling pattern, the hole type, and storing the hole-type-specific drilling parameters and drilling pattern in a memory of the drill rig; and during a drilling phase, the drill rig automatically selects the drilling parameters for each hole on the basis of the hole type of the hole being drilled by:

determining the hole type of the hole from the drilling pattern stored in the memory of the drill rig and selecting from the memory of the drill rig, the hole-type-specific drilling parameters that correspond to the determined hole type of the hole.

2. The method as claimed in claim 1, wherein the drilling parameters for the holes are determined in tunnel boring to suit tunnel excavation.

3. The method as claimed in claim 1, wherein the drilling parameters for the holes are determined in surface drilling to suit surface excavation.

4. The method as claimed in claim 1, wherein a drilling starting time is used as one of the drilling parameters.

5. The method as claimed in claim 1, wherein a maximum allowed striking power is used as one of the drilling parameters.

6. The method as claimed in claim 1, wherein a feed rate is used as one of the drilling parameters.

7. The method as claimed in claim 1, wherein a feed force is used as one of the drilling parameters.

8. The method as claimed in claim 1, wherein a rotation rate is used as one of the drilling parameters.

9. The method as claimed in claim 1, wherein alternative drilling control methods are used as one of the drilling parameters.

10. The method as claimed in claim 9, wherein as a drilling control method, ramp drilling is used wherein collaring is first performed at a low drilling power and at a low feed rate for a predetermined time or for a predetermined hole depth, whereafter a transition is made to normal drilling through a ramp phase by increasing the drilling power by a predetermined ratio for a predetermined time until values determined for normal drilling are reached, and that a duration time of the ramp phase is used as one of the drilling parameters.

11. The method as claimed in claim 1, wherein in addition to drilling the hole, the drilling phase includes positioning a drill boom of the drill rig into a drilling position required by the hole to be drilled, and that during the positioning of the drill boom, movement rates or movement time for different parts of the boom are used as drilling parameters.

12. The method as claimed in claim 1, wherein a flow rate of a flushing medium is used as one of the drilling parameters.

13. The method as claimed in claim 1, wherein a pressure of a flushing medium is used as one of the drilling parameters.

14. The method as claimed in claim 1, wherein in addition to drilling the hole, the drilling phase includes pulling a drill rod out of the hole, and wherein during the pulling out of the drill rod, a pulling rate and a flow rate of a flushing medium are used as drilling parameters.

15. The method as claimed in claim 1, wherein a drilling starting length is used as one of the drilling parameters.

* * * * *